US010184356B2

(12) United States Patent
McCaffrey

(10) Patent No.: US 10,184,356 B2
(45) Date of Patent: Jan. 22, 2019

(54) BLADE OUTER AIR SEAL SUPPORT STRUCTURE

(71) Applicant: United Technologies Corporation, Hartford, CT (US)

(72) Inventor: Michael G. McCaffrey, Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 247 days.

(21) Appl. No.: 14/931,929

(22) Filed: Nov. 4, 2015

(65) Prior Publication Data

US 2016/0146053 A1 May 26, 2016

Related U.S. Application Data

(60) Provisional application No. 62/083,998, filed on Nov. 25, 2014.

(51) Int. Cl.

| | |
|---|---|
| ***F01D 25/28*** | (2006.01) |
| ***F01D 11/08*** | (2006.01) |
| ***F01D 25/24*** | (2006.01) |

(52) U.S. Cl.

CPC ..... *F01D 25/28* (2013.01); *F01D 11/08* (2013.01); *F01D 25/24* (2013.01); *F01D 25/246* (2013.01); *F05D 2220/32* (2013.01); *F05D 2230/60* (2013.01); *F05D 2240/11* (2013.01); *F05D 2240/55* (2013.01); *F05D 2240/91* (2013.01)

(58) Field of Classification Search

CPC ..... F01D 25/28; F01D 25/246; F01D 11/08; F01D 25/24; F01D 25/26; F05D 2240/11; F05D 2230/60; F05D 2220/32; F05D 2240/55; F05D 2240/91

See application file for complete search history.

(56) References Cited

U.S. PATENT DOCUMENTS

| | | | | |
|---|---|---|---|---|
| 4,472,108 A * | 9/1984 | Pask | F01D 11/22 415/113 |
| 5,423,659 A | 6/1995 | Thompson | |
| 5,486,090 A | 1/1996 | Thompson et al. | |
| 5,538,393 A | 7/1996 | Thompson et al. | |
| 5,641,267 A * | 6/1997 | Proctor | F01D 11/08 415/173.1 |
| 6,393,331 B1 | 5/2002 | Chetta et al. | |
| 6,733,235 B2 * | 5/2004 | Alford | F01D 11/08 415/173.1 |

(Continued)

FOREIGN PATENT DOCUMENTS

| | | |
|---|---|---|
| EP | 1350927 | 5/2007 |
| WO | 2014163674 | 10/2014 |

OTHER PUBLICATIONS

The Extended European Search Report for European Application No. 15196236.2, dated May 6, 2016.

*Primary Examiner* — Eldon Brockman

(74) *Attorney, Agent, or Firm* — Carlson, Gaskey & Olds, P.C.

(57) ABSTRACT

A support structure for a gas turbine engine includes an axially extending portion that forms a loop. A radially extending portion extends radially inward from the axially extending portion. A plurality of retention members are attached to at least one of the axially extending portion and the radially extending portion for retaining a blade outer air seal.

18 Claims, 4 Drawing Sheets

(56) References Cited

U.S. PATENT DOCUMENTS

| | | | | |
|---|---|---|---|---|
| 7,063,503 | B2 * | 6/2006 | Meisels | F01D 25/24 415/116 |
| 7,374,395 | B2 * | 5/2008 | Durocher | F01D 9/04 415/115 |
| 9,458,726 | B2 * | 10/2016 | Lamusga | F01D 11/08 |
| 9,506,356 | B2 * | 11/2016 | Loftus | G01P 15/18 |
| 2003/0185674 | A1 * | 10/2003 | Alford | F01D 11/08 415/173.1 |
| 2004/0005216 | A1 * | 1/2004 | Suzumura | F01D 11/08 415/173.3 |
| 2005/0232752 | A1 * | 10/2005 | Meisels | F01D 25/24 415/116 |
| 2009/0208322 | A1 | 8/2009 | McCaffrey | |
| 2009/0232752 | A1 | 9/2009 | Carson et al. | |
| 2013/0108416 | A1 | 5/2013 | Piggush et al. | |
| 2015/0044049 | A1 * | 2/2015 | Lamusga | F01D 11/08 416/182 |

* cited by examiner

BLADE OUTER AIR SEAL SUPPORT STRUCTURE

CROSS-REFERENCE TO RELATED APPLICATIONS

This application claims priority to U.S. Provisional Application No. 62/083,998, which was filed on Nov. 25, 2014 and is incorporated herein by reference.

BACKGROUND

This disclosure relates to a gas turbine engine, and more particularly to a blade outer air seal (BOAS) that may be incorporated into a gas turbine engine.

Gas turbine engines typically include a compressor section, a combustor section, and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other loads.

The compressor and turbine sections of a gas turbine engine include alternating rows of rotating blades and stationary vanes. The turbine blades rotate and extract energy from the hot combustion gases that are communicated through the gas turbine engine. The turbine vanes direct the hot combustion gases at a preferred angle of entry into a downstream row of blades.

An engine case of an engine static structure may include one or more blade outer air seals (BOAS) that establish an outer radial flow path boundary for channeling the hot combustion gases. BOAS are typically mounted to the engine casing with one or more retention hooks.

SUMMARY

In one exemplary embodiment, a support structure for a gas turbine engine includes an axially extending portion that forms a loop. A radially extending portion extends radially inward from the axially extending portion. A plurality of retention members are attached to at least one of the axially extending portion and the radially extending portion for retaining a blade outer air seal.

In a further embodiment of the above, the radially extending portion extends from an axially downstream end of the axially extending portion.

In a further embodiment of any of the above, the axially extending portion and the radial portion are a unitary piece of material.

In a further embodiment of any of the above, the plurality of retention members is unitary with the axially extending portion and the radially extending portion.

In a further embodiment of any of the above, an axially extending protrusion forms spacing between the radially extending portion and the blade outer air seal.

In a further embodiment of any of the above, the axially extending protrusion is located on at least one of the radially extending portion and the blade outer air seal.

In a further embodiment of any of the above, the axially extending portion includes a plurality of axially extending tabs configured to mate with a corresponding groove in an engine case.

In a further embodiment of any of the above, at least a portion of the blade outer air seal is ceramic.

In another exemplary embodiment, a gas turbine engine includes an engine case and a support structure that forms a hoop including a plurality of retention members. A plurality of blade outer air seal engages at least one of the plurality of retention members.

In a further embodiment of any of the above, the support structure includes a radially extending portion that extends from an axially downstream end of an axially extending portion.

In a further embodiment of any of the above, the axially extending portion and the radial portion are a unitary piece of material.

In a further embodiment of any of the above, the plurality of retention members is attached to at least one of the axially extending portion and the radially extending portion.

In a further embodiment of any of the above, at least one of the radially extending portion and the blade outer air seal includes an axially extending protrusion.

In a further embodiment of any of the above, the axially extending protrusion engages a radially inner portion of a base of each of the plurality of blade outer air seals.

In a further embodiment of any of the above, the axially extending portion includes a plurality of axially extending tabs configured to mate with a corresponding groove in the engine case.

In a further embodiment of any of the above, there is a radial gap between the engine case and an aft portion of the support structure.

In another exemplary embodiment, a method of retaining a blade outer air seal includes securing a blade outer air seal to a retention member on a support structure and engaging a radially inner end of a base of a blade outer air with a radially extending portion of the support structure.

In a further embodiment of any of the above, the support structure includes an axially extending portion. The radially extending portion extends from a downstream end of the axially extending portion. An axially extending protrusion extends from at least one of the radially extending portion and the blade outer air seal.

In a further embodiment of any of the above, the axially extending portion and the radially extending portion are a unitary piece of material.

In a further embodiment of any of the above, the method includes biasing the blade out air seal against the axially extending protrusion with a forward seal.

The various features and advantages of this disclosure will become apparent to those skilled in the art from the following detailed description. The drawings that accompany the detailed description can be briefly described as follows.

DETAILED DESCRIPTION

Figure 1:
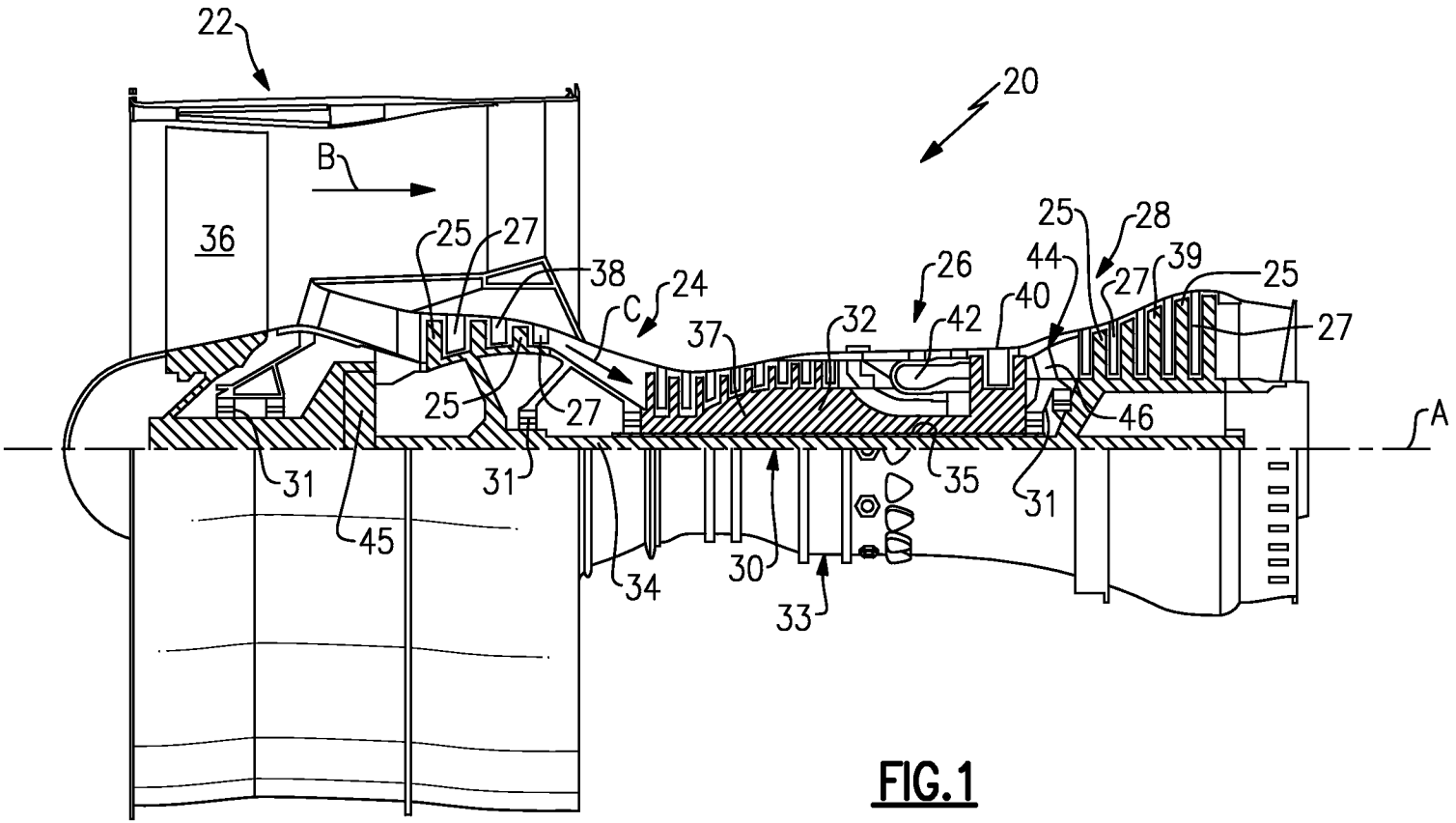
FIG. 1 is a schematic view of an example gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in this non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the fan 36 and/or the low pressure compressor 38 and the high pressure compressor 37, is mixed with fuel and burned in the combustor 42, and is then expanded through the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be calculated by measuring the pressure prior to the inlet of the low pressure turbine 39 and relating it to the pressure measured at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In one embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of [(Tram°R)/(518.7°R)]^0.5. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Figure 2:
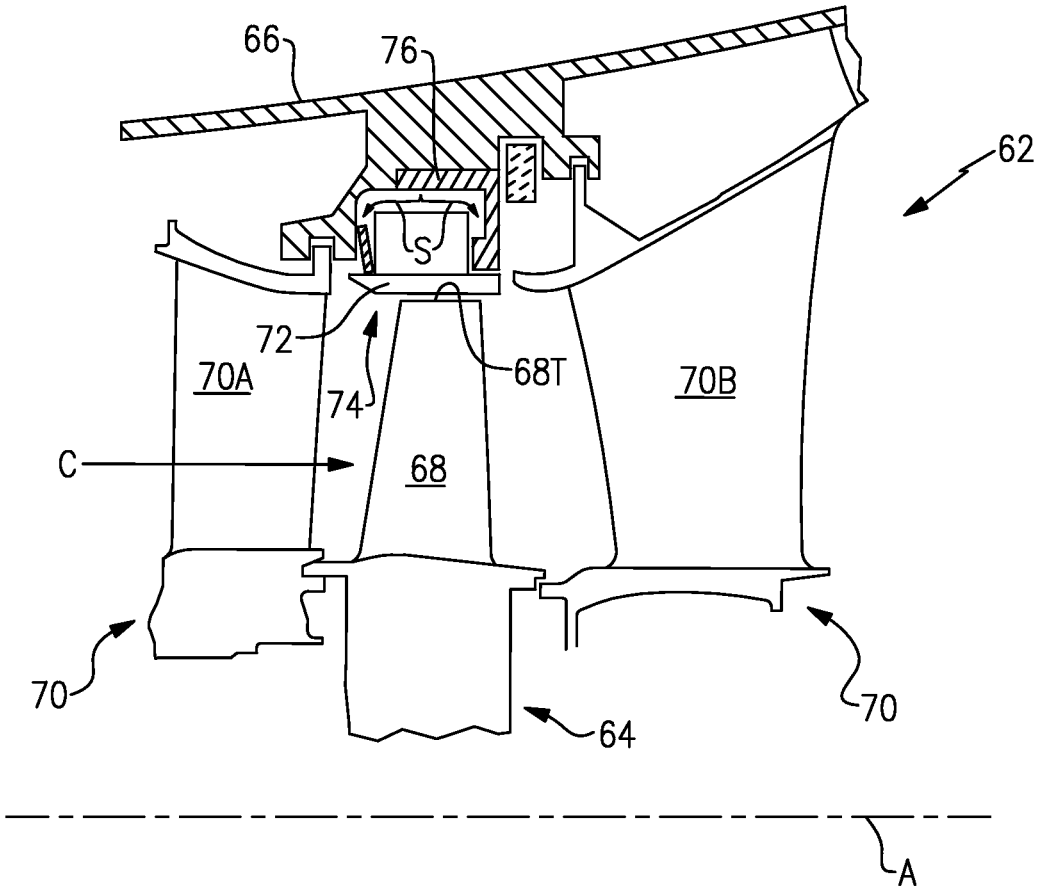
FIG. 2 illustrates a cross-section of a portion of the gas turbine engine.

FIG. 2 illustrates a portion 62 of a gas turbine engine, such as the gas turbine engine 20 of FIG. 1. In the illustrated embodiment, the portion 62 is representative of the high pressure turbine 40. However, it should be appreciated that other portions of the gas turbine engine 20 could benefit from the teachings of this disclosure, including but not limited to, the compressor section 24, and the low pressure turbine 39.

In one exemplary embodiment, a rotor disk 64 (only one shown, although multiple disks could be disposed within the portion 62) is mounted for rotation about the engine centerline longitudinal axis A relative to an engine case 66 of the engine static structure 33 (see FIG. 1). The portion 62 includes alternating rows of rotating blades 68 (mounted to the rotor disk 64) and vanes (features 70A, 70B) of vane assemblies 70 that are also supported relative to the engine case 66.

Each blade 68 of the rotor disk 64 extends to a blade tip 68T at a radially outermost portion of the blades 68. The blade tip 68T extends toward a blade outer air seal (BOAS) 72 (shown schematically in FIG. 2). The BOAS 72 may be a segment of a BOAS assembly 74. For example, a plurality of BOAS 72 may be circumferentially positioned relative to one another to provide a segmented BOAS assembly 74 that generally surrounds the rotor disk 64 and the blades 68 carried by the rotor disk 64.

Optionally, a secondary cooling fluid S that is separate from the core flow path C may be communicated into a space at least partially defined by the BOAS 72 to provide a dedicated source of cooling fluid for cooling the BOAS 72 and other nearby hardware. In one embodiment, the secondary cooling fluid S is airflow sourced from the high pressure compressor 37 or any other upstream portion of the gas turbine engine 20.

Figure 3:
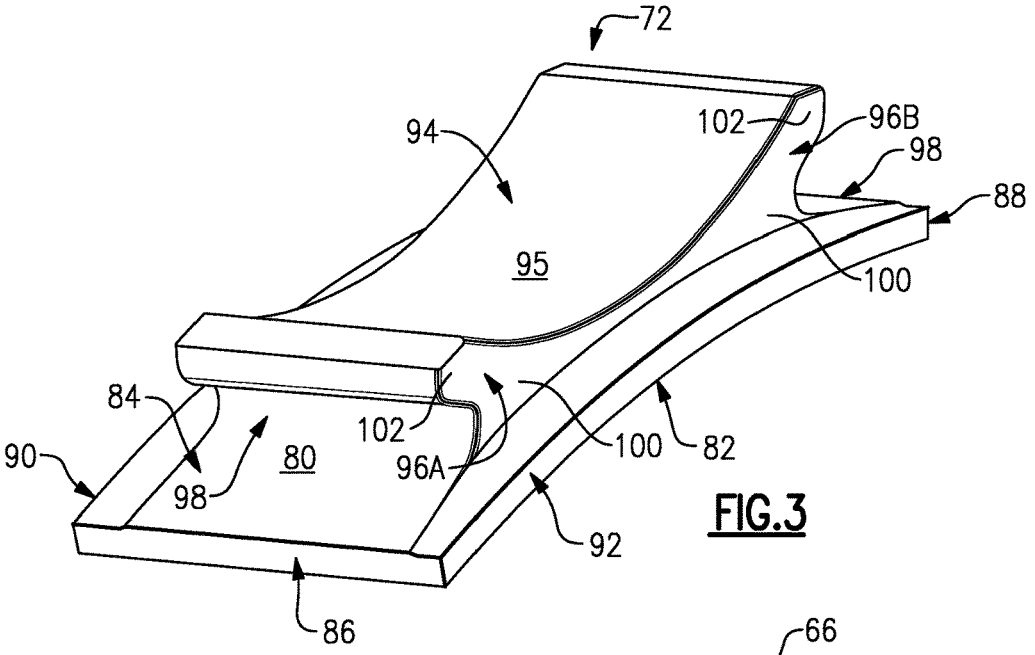
FIG. 3 illustrates a blade outer air seal.

FIG. 3, with continued reference to FIG. 2, illustrates a BOAS 72 that may be incorporated into a gas turbine engine, such as the portion 62 of FIG. 2. The BOAS 72 may include a ceramic body 80 having a radially inner face 82 and a radially outer face 84. In a mounted position, the radially inner face 82 faces toward the blade tip 68T and the radially outer face 84 faces toward the engine case 66 (see FIG. 2). The radially inner face 82 and the radially outer face 84 circumferentially extend between a first mate face 86 and a second mate face 88 and axially extend between a leading edge face 90 and a trailing edge face 92.

The BOAS 72 includes a retention feature 94 that extends from the radially outer face 84. In one embodiment, the ceramic body 80 and the retention feature 94 embody a unitary structure (i.e., a monolithic structure) manufactured of a ceramic, ceramic matrix composite, or other suitable ceramic material. The retention feature 94 may be utilized to mount the BOAS 72 relative to the engine case 66.

The retention feature 94 can include a curved body 95. In one non-limiting embodiment, the curved body 95 is curved in an opposite direction from a curvature of the radially inner face 82. In other words, in a mounted position, the curved body 95 is curved toward the engine case 66 and the radially inner face 82 is curved toward the blade tip 68T.

The retention feature 94 additionally includes at least one angled hook 96 that extends at a transverse angle relative to the radially outer face 84. In one embodiment, the retention feature 94 includes a first angled hook 96A near the first mate face 86 and a second angled hook 96B near the second mate face 88. The curved body 95 connects the first angled hook 96A to the second angled hook 96B. In other words, the angled hooks 96A, 96B establish opposing ends of the curved body 95.

Each angled hook 96 may extend between a base 100 and an end 102. The ends 102 of the angled hooks 96 are circumferentially offset from the first and second mate faces 86, 88, in one non-limiting embodiment.

In another non-limiting embodiment, each angled hook 96 is tapered between the base 100 and the end 102. Alternatively, only the end 102 of the angled hook 96 is tapered such that the ends 102 are V-shaped. As is discussed in greater detail below, the tapered surfaces of the angled hooks 96 aid in establishing a slidable interface for effectuating radially inboard movement of the BOAS 72 relative to the blade tip 68T in response to a temperature change, or thermal growth, of the engine case 66.

A recessed opening 98 extends between each angled hook 96 and the radially outer face 84 of the BOAS 72. Portions of a support structure 110 (see FIGS. 4 and 5) may be received within the recessed opening 98 to mount the BOAS 72 relative to the engine case 66.

Figure 4:
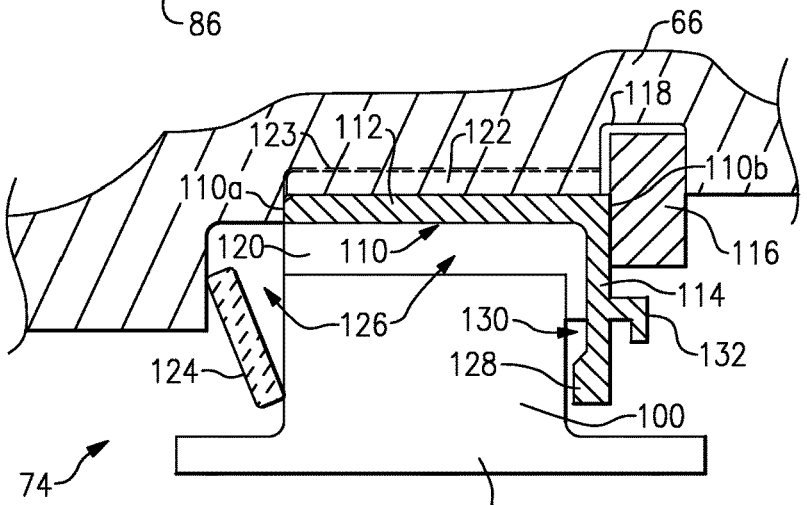
FIG. 4 illustrates an enlarged view of FIG. 2.

FIG. 4 illustrates an enlarged view of the BOAS assembly 74 from FIG. 2. The support structure 110 is located between the BOAS 72 and the engine case 66 to secure the BOAS 72 to the engine case 66. The support structure 110 is an annular ring that forms a loop and includes an axially extending portion 112 and a radially extending portion 114. The axially extending portion 112 is in abutting contact with the engine case 66 and is generally parallel to the engine axis A. An axially forward end 110*a* of the support structure 110 is in abutting contact with the engine case 66 to prevent the support structure 110 from moving axially forward.

The support structure 110 is prevented from moving axially rearward by a segmented retention ring 116 located within a groove 118 in the engine case 66 that abuts an aft end 110*b* of the support structure 110. A plurality of axially extending tabs 122 (FIGS. 4 and 5) extend radially outward from an outer surface of the axially extending portion 112 and mates with a corresponding axially extending groove 123 (shown in dashed lines in FIG. 4) in the engine case 66.

Figure 5:
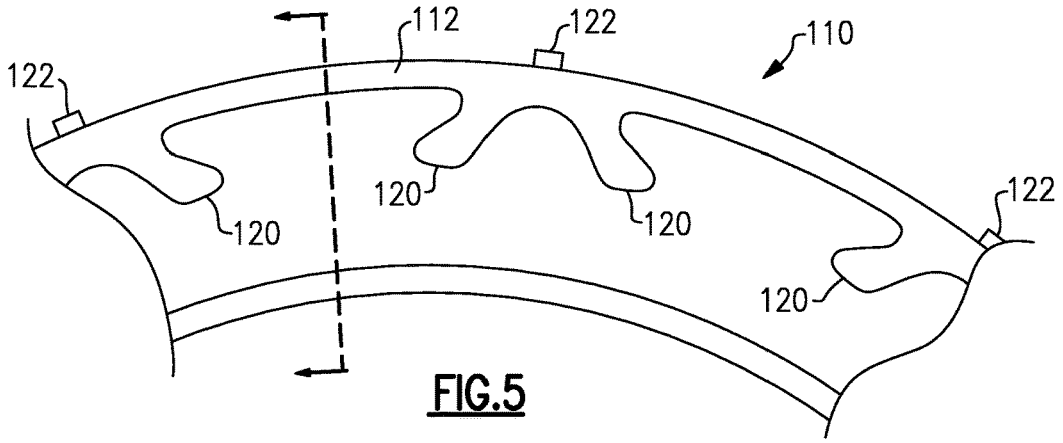
FIG. 5 illustrates an example structural support.

As shown in FIGS. 4 and 5, the support structure 110 includes retention members 120 for securing the BOAS 72 to the support structure 110. In the illustrated example, the retention members 120 are integrally formed with the support structure 110 and are attached to both the axially extending portion 112 and the radially extending portion 114. However, the retention members 120 could also be a separate element that is fastened to the support structure 110 with a pin extending from the retention members 120 and secured to the support structure 110 with a nut or other mechanical device. Alternatively, the retention members 120 could be welded to the support structure 110 if the support structure 110 and the retention members 120 were made of a metical material. Additionally, the support structure 110 and the retention members 120 could be made of a ceramic material.

A front seal 124 applies a biasing force against an axially forward face on the base 100 of the BOAS 72 to create a seal between the engine case 66 and the axially forward face on the base 100. The biasing force from the front seal 124 also creates a seal against the radially extending portion 114 and the base of the BOAS. Therefore, the front seal 124 helps to seal a chamber 126 formed by the BOAS 72, the front seal 124, the support structure 110, and the engine case 66. Because the support structure 110 is made of a single unitary piece of material, there are fewer opportunities for leakage of pressurized air from the chamber 126 through gaps in adjacent segments. Additionally, because the radially extending portion 114 is secured to the axially extending portion 112, a greater force can be applied to the radially extending portion 114 by the front seal 124 to improve the seal between the BOAS 72 and the radially extending portion 114.

A distal end of the radially extending portion 114 includes an axially extending protrusion 128 that extends forward and contacts the base 100 of each of the BOAS 72. In the illustrated, the axially extending protrusion 128 contacts a radially outer half of the base 100. In another example, the axially extending protrusion 128 contacts a radially outer third of the base 100.

The axially extending protrusion 128 includes forms a spacing 130 between an axial downstream side of the base 100 and the radially extending portion 114 to create a passage for pressurized air to travel. Since the axially extending protrusion 128 contacts a radially inward portion of the base 100, a greater portion of the base 100 is able to be cooled by the pressurized air.

Because the support structure 110 is a continuous ring, each of the BOAS 72 can be installed onto the support structure 110 and installed onto the gas turbine engine 20 as a single cartridge. Once each of the BOAS 72 are placed on the support structure 110, the support structure 110 along with the BOAS 72 are moved from a rearward portion of the gas turbine engine 20 axially forward until the axially forward end 110*a* of the support structure 110 is in abutting contact with the engine case 66. The front seal 124 can either be placed on the gas turbine engine 20 prior to installing the support structure 110 or at the same time as the support structure 110 and BOAS 72 cartridge.

Once the front seal 124 and the support structure 110 with the BOAS 72 have been installed, the segmented retention ring 116 is placed in the groove 118. The segmented retention ring 116 abuts the aft end 110*b* of the support structure 110 to prevent the support structure 110 from moving axially rearward and to control the biasing force being applied by the front seal 124.

To remove the support structure 110 with the BOAS 72, the segmented retention ring 116 is removed first. A protrusion 132 forming a lip on an axially aft side of the radially extending portion 114 of the support structure 110 is engaged by hand or with a removal tool and pulled axially aft to separate the support structure 110 from the engine case 66. If the front seal 124 does not separate from the engine case 66 with the support structure 110 and BOAS 72, the front seal 124 can be removed separately by moving the front seal 124 axially aft relative to the gas turbine engine 20. The gas turbine engine 20 can then be serviced and any damaged or worn BOAS 72 can be repaired or replaced.

Figure 6:
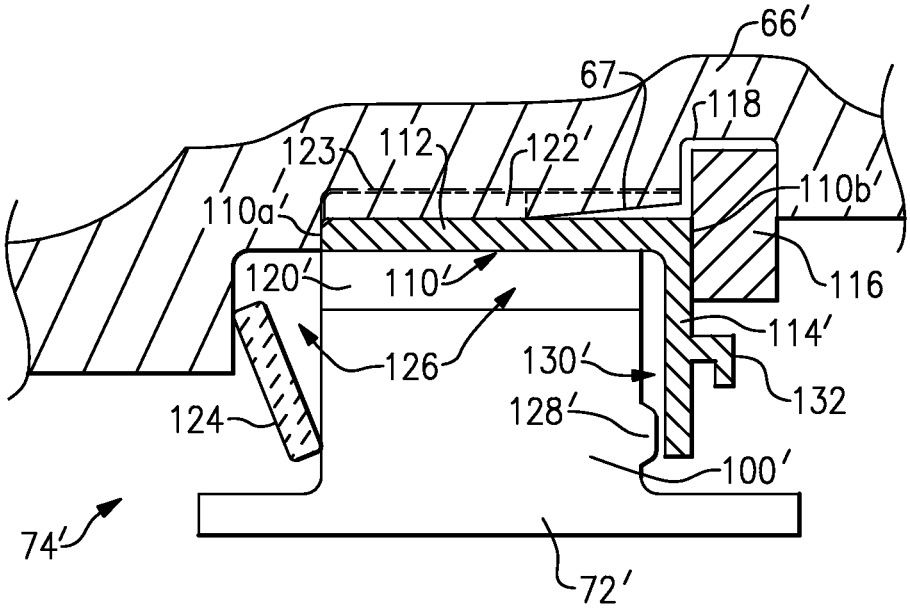
FIG. 6 illustrates an example segmented blade outer air seal.

FIG. 6 illustrates another example segmented BOAS assembly 74'. The segmented BOAS assembly 74' is similar to the segmented BOAS assembly 74 except where described below or shown in the Figures. An engine case 66' surrounds a support structure 110'. The engine case 66' includes a radially outward taper 67 along an aft portion of the support structure 110' forming a radial gap to allow for radial growth of the aft portion of the support structure 110'. In one example, the radially outward taper 67 extends along approximately 50% of the support structure 110'. In another example, the radially outward trapper 67 extends along approximately 30% of the support structure 110'. In yet another example, the support structure 110' may include a radially inward taper on an aft portion of the support structure 110' to form the radial gap between the support structure 110' and the engine case 66'.

A plurality of axially extending tabs 122' extend from an axially forward end 110*a'* of the support structure 110' toward an aft end 110*b'* along only a portion of the support structure 110'. In one example, the plurality of axially extending tabs 122' extends along approximately 50% of the support structure 110'. In another example, the plurality of axially extending tabs 122' extends along approximately 70% of the support structure 110'.

A BOAS 72' includes an axially extending protrusion 128' along an aft portion of the BOAS 72'. The axially extending protrusion 128' on the BOAS 72' engages a radially extending portion 114' on the support structure 110'. The axially extending protrusion 128' forms a spacing 130' between an axial downstream side of a base 100' of the BOAS 72' and the radially extending portion 114' to create a passage for pressurized air to travel.

The support structure 110' includes retention members 120' for securing the BOAS 72' to the support structure 110'. In the illustrated example, the retention members 120' are attached to the axially extending portion 112' and are spaced from the radially extending portion 114'.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A support structure for a gas turbine engine comprising:
an axially extending portion forming a loop;
a radially extending portion extending radially inward from the axially extending portion; and
a plurality of retention members fixed to the axially extending portion for retaining a blade outer air seal and the plurality of retention members extend axially downstream from a leading edge of the axially extending portion and the plurality of retention members are circumferentially spaced from each other and adjacent retention members of the plurality of retention members define a receptacle for accepting a blade outer air seal inserted in an axial direction.

2. The support structure of claim 1, wherein the radially extending portion extends from an axially downstream end of the axially extending portion and each of the plurality of retention members extend from the leading edge of the axially extending portion to a trailing edge of the axially extending portion.

3. The support structure of claim 2, wherein the axially extending portion and the radial portion are a unitary piece of material and form a continuous ring.

4. The support structure of claim 3, wherein the plurality of retention members are unitary with the axially extending portion and the radially extending portion.

5. The support structure of claim 1, further comprising an axially extending protrusion extending from the radially extending portion for contacting a retention feature on the blade outer air seal.

6. The support structure of claim 5, wherein the loop is a continuous, the axially extending portion and the radial portion are a unitary piece of material, the plurality of retention members extend from the radially extending portion in an upstream direction along the axially extending portion, and the axially extending portion includes a plurality of axially extending tabs configured to mate with a corresponding one of a plurality of grooves in an engine case.

7. The support structure of claim 1, wherein the axially extending portion includes a plurality of axially extending tabs configured to mate with a corresponding groove in an engine case.

8. The support structure of claim 1, wherein the loop is continuous, the axially extending portion and the radial portion are a unitary piece of material, and the plurality of retention members extend from the radially extending portion in an upstream direction along the axially extending portion.

9. A gas turbine engine comprising:
an engine case;
a support structure forming a hoop including a plurality of retention members fixed to the support structure;
a plurality of blade outer air seals engaging at least one of the plurality of retention members; and
a biasing seal contacting the engine case and an upstream side of a base of the blade outer air seal and a segmented retention ring located in a groove in the engine case and contacting a surface on the support structure.

10. The gas turbine engine of claim 9, wherein the support structure includes a radially extending portion extending from an axially downstream end of an axially extending portion.

11. The gas turbine engine of claim 10, wherein the axially extending portion and the radial portion are a unitary piece of material.

12. The gas turbine engine of claim 11, wherein the plurality of retention members are attached to at least one of the axially extending portion and the radially extending portion.

13. The gas turbine engine of claim 10, wherein one of the radially extending portion and a retention portion of the plurality of blade outer air seals includes an axially extending protrusion that engages the other of the radially extending portion and the retention portion of the plurality of blade outer air seals.

14. The gas turbine engine of claim 13, wherein the hoop is continuous, the axially extending portion and the radial portion are a unitary piece of material, and the plurality of retention members extend from the radially extending portion in an upstream direction along the axially extending portion.

15. The gas turbine engine of claim 10, wherein the axially extending portion includes a plurality of axially extending tabs configured to mate with a corresponding groove in the engine case.

16. The gas turbine engine of claim 15, further comprising a radial gap between the engine case and an aft portion of the support structure, wherein the radial gap increases from a mid-portion of the support structure to the aft portion of the support structure and defines a slanted surface.

17. A method of retaining a blade outer air seal comprising:

securing a blade outer air seal to at least one retention member on a support structure, wherein the support structure includes an axially extending portion extending from a downstream end of the axially extending portion; and engaging a retention portion of the blade outer air seal with a radially extending portion of the support structure; and engaging an axially extending protrusion extending from one of the radially extending portion and the retention portion of the blade outer air seal with a surface on the other of the radially extending portion and the retention portion; and biasing the blade out air seal against the axially extending protrusion with a forward seal and retaining the support structure relative to an engine case with a segmented retention ring located in a groove in the engine case.

18. The method of claim 17, wherein the support structure is an annular ring, the axially extending portion and the radially extending portion are a unitary piece of material, and the at least one retention member extends from the radially extending portion upstream along the axially extending portion.

* * * * *